US007772775B2

(12) United States Patent
Rho et al.

(10) Patent No.: US 7,772,775 B2
(45) Date of Patent: Aug. 10, 2010

(54) PLASMA DISPLAY PANEL (PDP)

(75) Inventors: Chang-Seok Rho, Suwon-si (KR); Young-Ho Chin, Suwon-si (KR); Jung-Hyuck Choi, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 369 days.

(21) Appl. No.: 12/068,224

(22) Filed: Feb. 4, 2008

(65) Prior Publication Data

US 2008/0129199 A1 Jun. 5, 2008

Related U.S. Application Data

(63) Continuation of application No. 11/264,014, filed on Nov. 2, 2005, now Pat. No. 7,345,424.

(30) Foreign Application Priority Data

Nov. 4, 2004 (KR) ..... 10-2004-0089275

(51) Int. Cl.
*H01J 17/49* (2006.01)

(52) U.S. Cl. ..... 313/582; 313/587

(58) Field of Classification Search ..... 313/582–587
See application file for complete search history.

(56) References Cited

U.S. PATENT DOCUMENTS 5,541,618 A 7/1996 Shinoda (Continued)

FOREIGN PATENT DOCUMENTS

EP 1 435 639 7/2004

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms and Discharge Characteristics; Annex C—Gaps and Annex D—Manufacturing.

(Continued)

*Primary Examiner*—Nimeshkumar D. Patel
*Assistant Examiner*—Anne M Hines
(74) *Attorney, Agent, or Firm*—Robert E. Bushnell, Esq.

(57) ABSTRACT

A Plasma Display Panel (PDP), in which the precision level in shaping the display electrodes is improved by changing the shape of the transparent electrode, includes: address electrodes formed on a first substrate, barrier ribs defining discharge cells in a space between the first substrate and a second substrate and display electrodes, formed on the second substrate in a direction crossing the address electrodes, including a pair of line portions arranged on both sides of each discharge cell and having a pair of protrusion portions, facing each other, extending from the respective line portions toward the center of each discharge cell. The pair of the protrusion portions has rounded contours at both corners of each protrusion portion facing the paired protrusion portion and its radius R1 of curvature at the corner satisfies the following condition: 0.05a=R1=0.2a, where a is a width of the protrusion portion measured in the extending direction of the line portion.

9 Claims, 4 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0047591 | A1 | 4/2002 | Hirano et al. | |
| 2005/0212430 | A1* | 9/2005 | Ahn et al. | 313/587 |

FOREIGN PATENT DOCUMENTS

| | | |
|---|---|---|
| JP | 2845183 | 10/1998 |
| JP | 11-096921 | 4/1999 |
| JP | 2917279 | 4/1999 |
| JP | 2001-043804 | 2/2001 |
| JP | 2001-325888 | 11/2001 |
| JP | 2002-203487 | 7/2002 |
| JP | 2002-324488 | 11/2002 |
| JP | 2004-214205 | 7/2004 |
| KR | 1999-0056758 | 7/1999 |
| KR | 10-2002-0026040 | 4/2002 |
| KR | 10-2004-0058566 | 7/2004 |
| KR | 10-2004-0062381 | 7/2004 |

OTHER PUBLICATIONS

European Office Action of the European Patent Application No. 05 11 0284, mailed on Apr. 6, 2006.

* cited by examiner

PLASMA DISPLAY PANEL (PDP)

CLAIM OF PRIORITY AND CROSS-REFERENCE TO RELATED APPLICATION

This application makes reference to, incorporates the same herein, and claims all benefits accruing under 35 U.S.C. §119 from an application for PLASMA DISPLAY PANEL earlier filed in the Korean Intellectual Property Office on 4 Nov. 2004 and there duly assigned Ser. No. 10-2004-0089275. Furthermore, this application is a continuation of Applicants' Ser. No. 11/264,014 filed in the U.S. Patent & Trademark Office on 2 Nov. 2005, issued on 18 Mar. 2008 as U.S. Pat. No. 7,345,424, and assigned to the assignee of the present invention.

BACKGROUND OF THE INVENTION

1. Field of the Invention

The present invention relates to a Plasma Display Panel (PDP) and, in particular, to a PDP in which the shape, of transparent electrode layers is changed for high precision in shaping display electrodes.

2. Description of the Related Art

In general, a Plasma Display Panel (PDP) is a display device in which ultraviolet rays generated by a gas discharge excite phosphors to produce an image and has an advantage over a cathode ray tube due to its large screen with thin depth and high resolution.

In a typical Alternating Current (AC) PDP, discharge cells are defined by barrier ribs placed between a front substrate and a rear substrate. Corresponding to each discharge cell, address electrodes are formed on the rear substrate and display electrodes, comprising a sustain electrode and scan electrodes, are formed on the front substrate. The address electrode and the display electrodes are covered with respective dielectric layers. Each discharge cell has a phosphor layer with one of red, blue and green phosphors formed thereon and is filled with a discharge gas (generally, a gas mixture of Ne—Xe).

In such a PDP, a discharge cell for light emission is selected by the address discharge that occurs by an address voltage supplied between the address electrode and the scan electrode. Then, a plasma discharge takes place inside the selected discharge cell due to a sustain voltage (Vs) supplied between the sustain electrode and the scan electrode, and the plasma emits vacuum ultraviolet rays that excite the phosphor layer in the discharge cell to emit visible light to form an image.

For the operation of the PDP, the sustain electrode and the scan electrode are made of a transparent electrode layer, such as Indium-Tin Oxide (ITO), so that both electrodes can transmit the visible light generated by the discharge cell. The conductance of each transparent electrode layer is compensated for by a bus electrode layer made of a metallic material such as silver.

The following steps can be applied for forming the transparent electrode: (1) forming an ITO layer on the entire front substrate, (2) forming a mask layer on the ITO layer by a well known photolithography process, (3) etching the unmasked ITO layer and (4) stripping the mask layer and cleaning/drying. Alternatively, the following steps can be applied for forming the transparent electrode: (1) forming an ITO layer on the entire front substrate, (2) etching the ITO layer directly by laser using a wavelength of 1,064 nm for easy vaporization.

The transparent electrode layer of the PDP in the early period is formed in strip pattern, and characteristics of discharging in the discharge cell are influenced by only the line-width and the discharge gap thereof. In order to improve discharge efficiency, however, a new structure is recently introduced in which the line-width of the transparent electrode layer is reduced in the non-discharge region between the discharge cells while the line-width of the transparent electrode layer is increased in the discharge region of the discharge cell.

Also, there is an attempt to increase the discharge efficiency by changing the plane shape of the discharge cell into a polygon over than a rectangle. Accordingly, the transparent electrode layer of the display electrode has the variety in plane shape.

However, this complicated shape of the transparent electrode layer causes a problem in that its corners, compared with other line portions, has a high degree of roughness due to an increase in process variations during the patterning of the transparent electrode layer by wet etching or laser etching. That causes the deterioration of the precision level of shaping the transparent electrode layer, which leads to poor discharge characteristics, such as misdischarge and display failures such as image stains.

SUMMARY OF THE INVENTION

The present invention provides a PDP in which the precision level in shaping the display electrodes is improved by changing the shape of the transparent electrode so as to improve the discharge characteristics and to prevent the display failures.

According to an exemplary embodiment of the present invention, a Plasma Display Panel (PDP) includes address electrodes formed on a first substrate, barrier ribs defining discharge cells in a space between the first substrate and a second substrate and display electrodes, formed on the second substrate in the direction crossing the address electrodes, including a pair of line portions formed at both sides of each discharge cell a pair of protrusion portions, facing each other, extending from the respective line portions toward the center of each discharge cell. The pair of the protrusion portions has rounded contours at both corners of each protrusion portion facing the paired protrusion portion and its radius R1 of curvature at the corner satisfies the following condition:

$$0.05a \leqq R1 \leqq 0.2a,$$

wherein a represents the width of the protrusion portion measured in the extending direction of the line portion.

The rounded contour can be formed at the corners connecting the protrusion portions to the line portions. The radius R2 of curvature at the corner satisfies the following condition:

$$0.05b \leqq R2 \leqq 0.2b$$

wherein b represents the distance between the protrusion portions measured in the extending direction of the line portion.

Each of the radii R1 and R2 preferably falls within the range of 10~150 μm.

The PDP of the present invention can improve the level of precision in shaping the transparent electrode layers by rounding off both corners of each protrusion portion facing the paired protrusion portion, to reduce the roughness due to process variations. Therefore, the PDP of the present invention can improve the discharge characteristics and to prevent display failure and to expand the discharge voltage margin.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
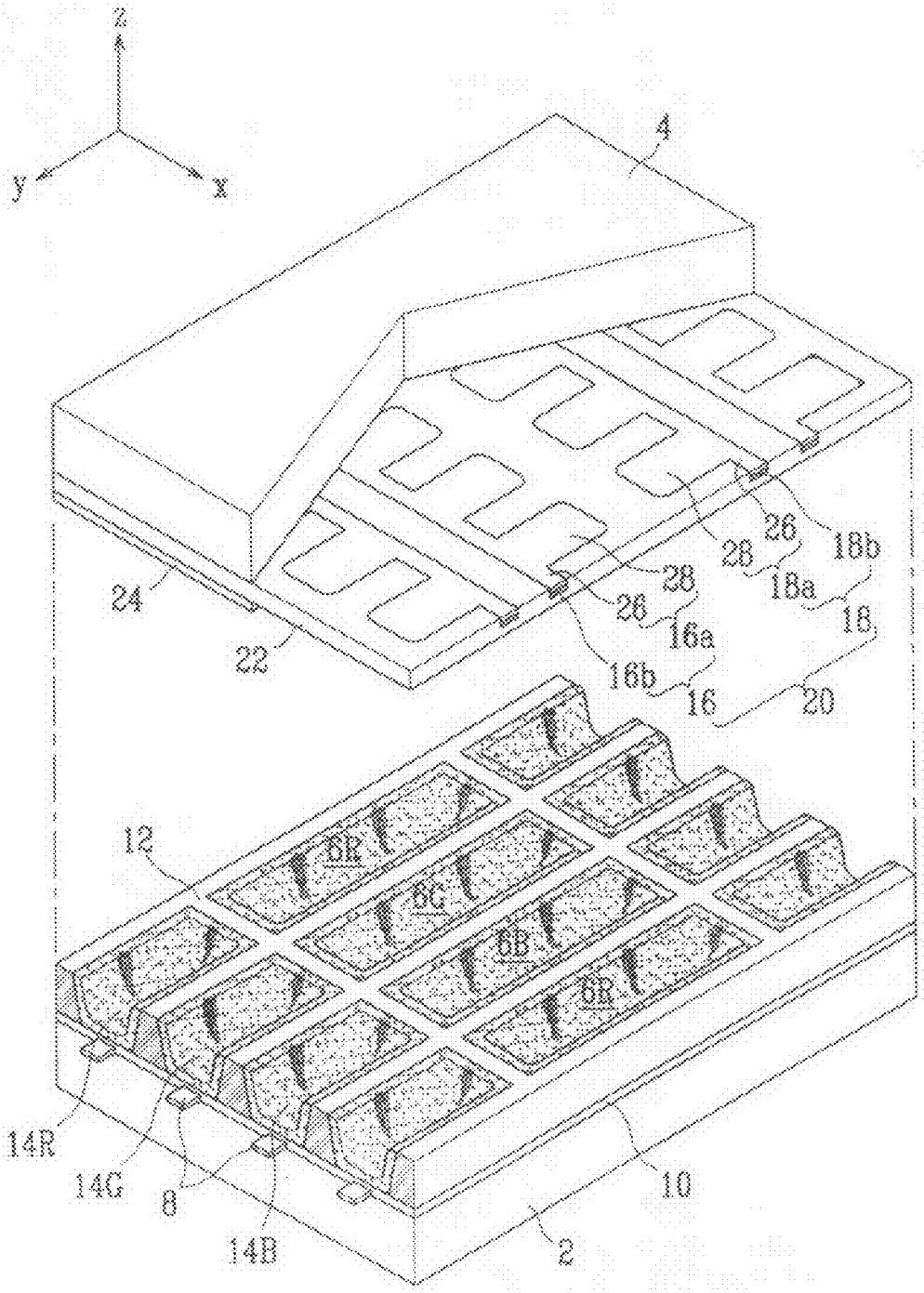
FIG. 1 is a partial perspective view of a disassembled PDP according to a first embodiment of the present invention.
Figure 2:
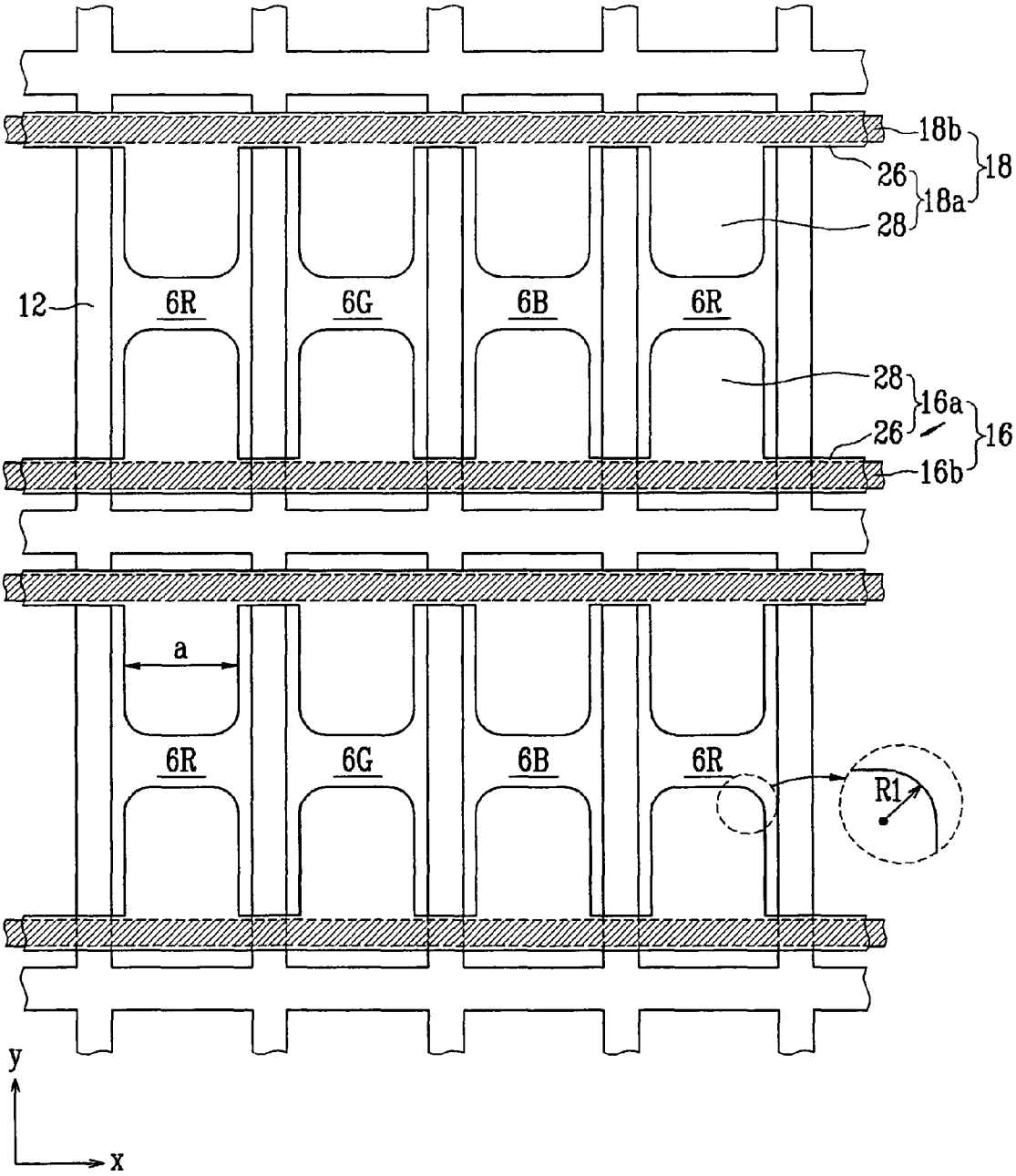
FIG. 2 is a partial plan view of the PDP according to the first embodiment of the present invention.

As shown in FIGS. 1 and 2, a Plasma Display Panel (PDP) according to the first embodiment of the present invention includes a first substrate 2, a second substrate 4 facing the first substrate 2 and spaced apart therefrom, and discharge cells 6R, 6G, and 6B positioned between the first substrate 2 and the second substrate 4. A color image of the PDP is produced by visible light generated by each discharge cell 6R, 6G, and 6B operating with an independent discharge mechanism.

Address electrodes 8 are formed in one direction (y-axis direction) on the inner surface of the first substrate 2, and a first dielectric layer 10 is formed on the entire inner surface of the first substrate 2 to cover the address electrodes 8. The address electrodes 8 are arranged, for example, in stripe pattern so that each address electrode is in parallel to the neighboring address electrodes with a gap therebetween.

On top of the first dielectric layer 10, lattice-shaped barrier ribs 12 are formed in the extending direction of the address electrodes 8 and in the crossing direction (x-axis direction) and define the discharge cells 6R, 6G, and 6B. A phosphor layer 14R, 14G, and 14B with one of red, green and blue phosphors is coated on four sidewalls of each discharge cell 6R, 6G, and 6B and on the first dielectric layer 10 thereof. The shape of the barrier ribs 12 is not limited to a lattice structure, and can be a stripe-pattern or other closed structures.

Display electrodes 20, including scan electrodes 16 and sustain electrodes 18, are formed on the inner surface of the second substrate 4 facing the first substrate 2, both the scan electrodes 16 and sustain electrodes 18 are formed in a direction crossing the extending direction of the address electrodes 8. A transparent second dielectric layer 22 and a MgO protective layer 24 are formed on the entire inner surface of the second substrate 4 to cover the display electrodes 20.

In the present embodiment, both the scan electrodes 16 and the sustain electrodes 18 are formed as a layered structure including transparent electrode layers 16*a* and 18*a* and bus electrode layers 16*b* and 18*b*. The transparent electrode layers 16*a* and 18*a* are formed to increase the aperture ratio of a PDP and are made of Indium-Tin Oxide (ITO). The bus electrode layers 16*b* and 18*b* are made of silver (Ag) or a multi-layered laminate of chrome (Cr)/copper (Cu)/chrome (Cr) to compensate for the conductance of the transparent electrode layers 16*a* and 18*a* and to prevent a voltage drop by the display electrode 20.

The transparent electrode layers 16*a* and 18*a* include a pair of line portions 26 placed at positions corresponding to two facing sides of each of the discharge cells 6R, 6G, and 6B and a pair of protrusion portions 28 extending from the respective line portions 26 towards the center of each of the discharge cells 6R, 6G, and 6B. The protrusion portions 28 serve to trigger plasma discharges inside the discharge cells 6R, 6G, and 6B. The bus electrode layers 16*b* and 18*b* are formed on the line portions 26 of the transparent electrode layers 16*a* and 18*a* and are in the same pattern as the line portions 26 thereof.

The shape of the transparent electrode layers 16*a* and 18*a*, including the line portions and the protrusion portions 28, is designed to prevent crosstalk between the neighboring discharge cells in the extending direction of the display electrodes 20.

The PDP includes the first substrate 2 and the second substrate 4 sealed together at their edges, and the discharge cells 6R, 6G, and 6B filled with a discharge gas (generally a gas mixture of Ne—Xe) therebetween.

In order to raise the level of precision in shaping the transparent electrode layers 16*a* and 18*a*, the present embodiment provides a pair of the protrusion portions 28 with a rounded contour at both corners of each protrusion portion facing the paired protrusion portion. As a result, roughness due to process variations are reduced at the rounded corners of the protrusion portions 28 so that the corners of the protrusion portions 28 have the same level of precision as the line portion during the patterning of the transparent electrode layers 16*a* and 18*a* by wet etching or laser ablation.

In particular, the radius R1 of curvature at the corner of the protrusion portions 28 must satisfy the following condition to be compatible with the width of the protrusion portions 28.

$$0.05a \leqq R1 \leqq 0.2a, \qquad \text{Formula 1}$$

where a represents the width of the protrusion portion 28 measured in the extending direction of the line portion 26 (see FIG. 2).

When the radius R1 of curvature at the corner of the protrusion portions 28 is less than 0.05a, the rounded shape of the corners has little influence on reducing the process variations. Therefore, roughness at the corners increases due to the process variations. Also, when the radius R1 of curvature is greater than 0.2a, the rounded area of the corner is so enlarged that the overall shape of the protrusion portion 28 can be distorted. Given the width of the protrusion portions 28 in real applications, it is preferable to set the radius R1 of curvature at the corner to be in the range of 10~150 μm.

As described above, in the PDP of the present embodiment, the level of precision in shaping the transparent electrode layers 16*a* and 18*a* is improved by satisfying the Formula 1.

Figure 3:
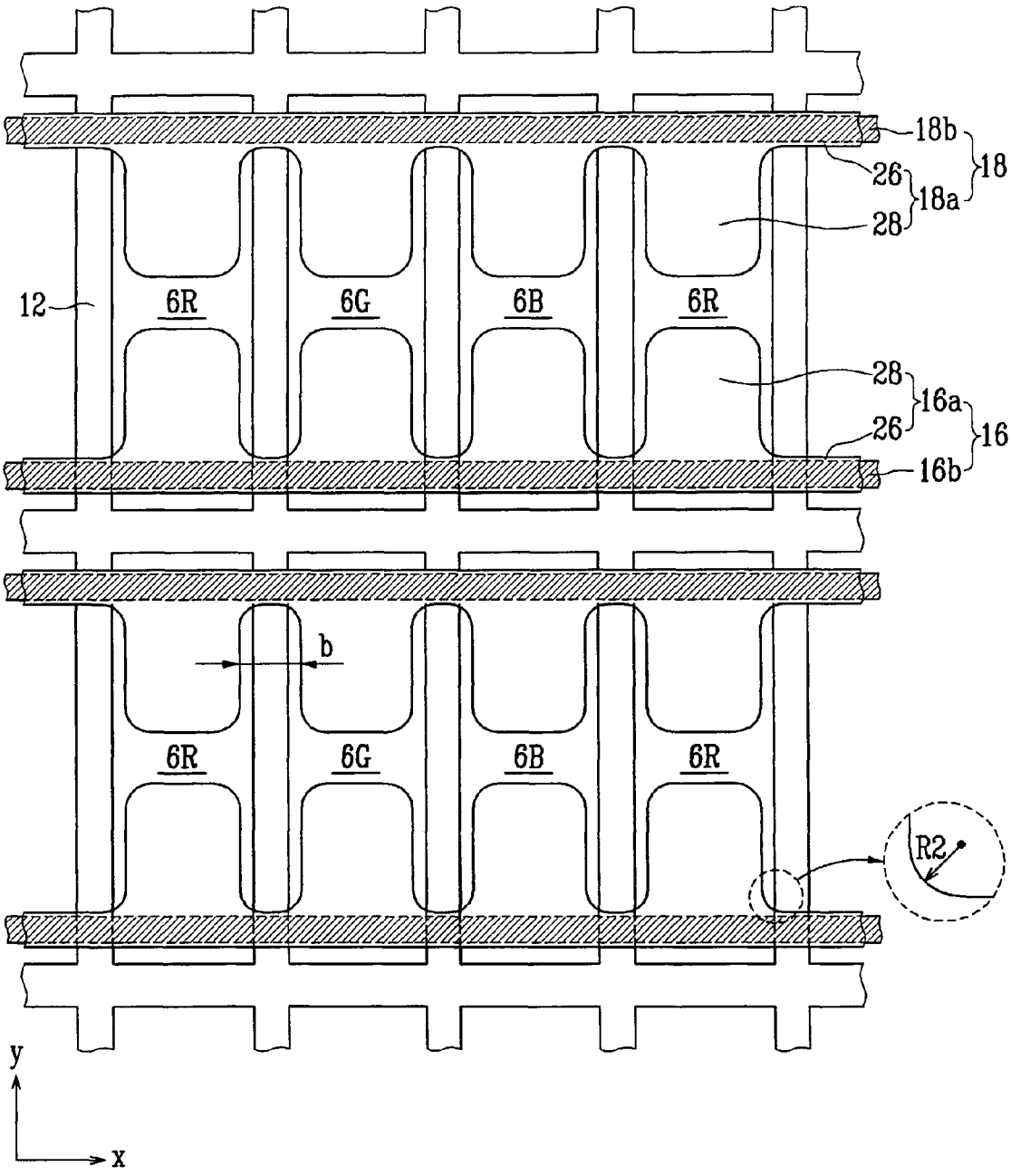
FIG. 3 is a partial plan view of a PDP according to a second embodiment of the present invention.

In a second embodiment as shown in FIG. 3, all of the components of the second embodiment are the same as those of the first embodiment except that the corners connecting the protrusion portions 28 to the line portions 26 are rounded. The radius R2 of curvature at the corner must satisfy the following condition to be compatible with the distance b between the protrusion portions 28 measured in the extending direction (x-axis direction) of the line portion 26.

$$0.05b \leqq R2 \leqq 0.2b \qquad \text{Formula 2}$$

When the radius R2 of curvature at the corner is less than 0.05b, the rounded shape of the corners has little influence on reducing the process variations. Therefore, roughness at the corners increases due to the process variations. Also, when the radius R2 of curvature is greater than 0.2b, the rounded area of the corner is so enlarged that the overall shapes of both the protrusion portion 28 and the line portion 26 can be distorted. Given the distance b between the protrusion portions 28 in real applications, it is preferable to set the radius R2 of curvature at the corner to be in the range of 10~150 μm.

Figure 4:
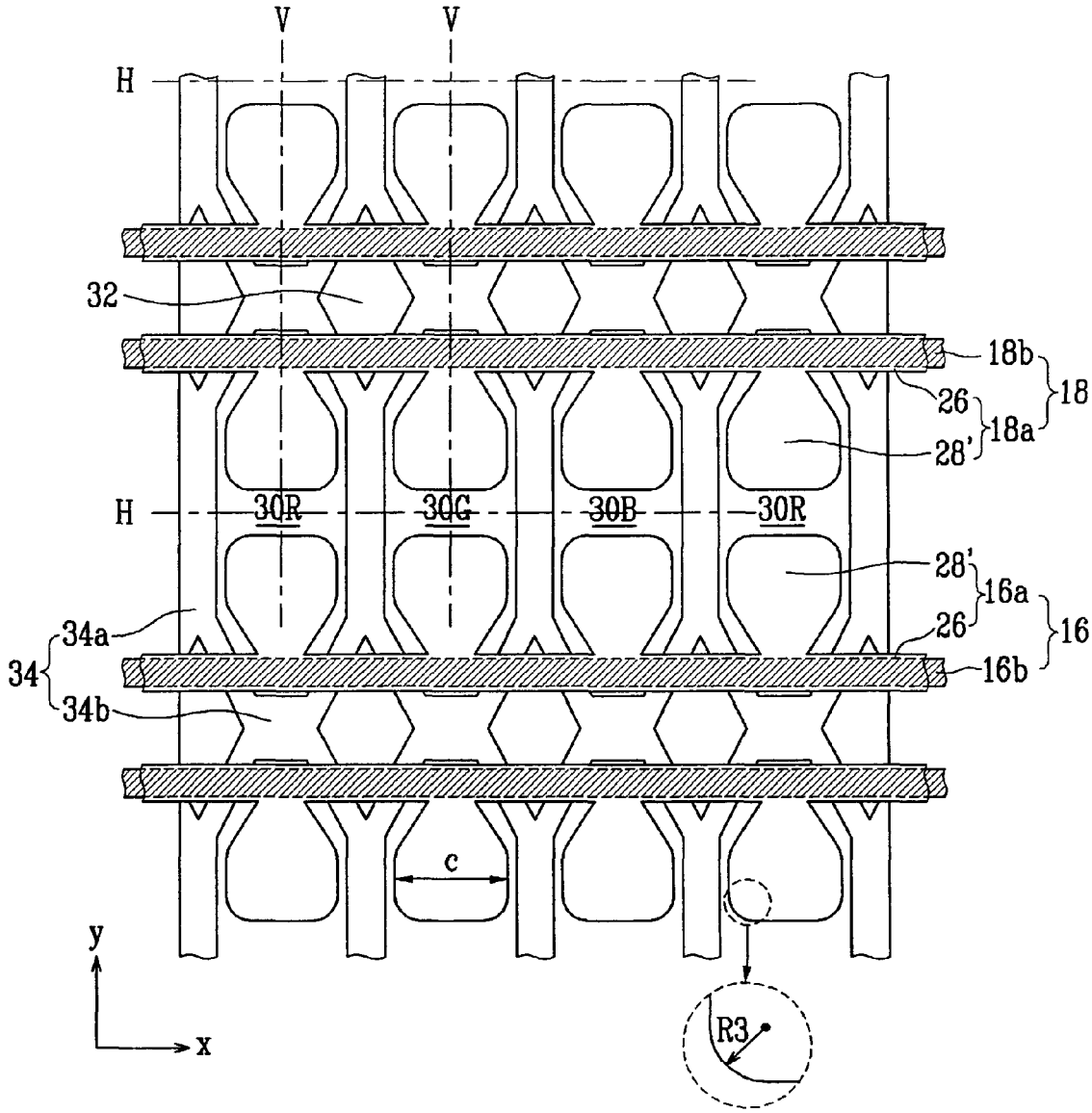
FIG. 4 is a partial plan view of a PDP according to a third embodiment of the present invention.

In a third embodiment as shown in FIG. 4, barrier ribs 34 are formed to define discharge cells 30R, 30G, and 30B and non-discharge regions 32. The discharge cells 30R, 30G, and 30B are arranged in a space in which a gas discharge and light emission are to occur, and the non-discharge region 32 is arranged in a space or region in which no gas discharge or light emission is to occur. The drawing shows an exemplary structure of the discharge cells 30R, 30G, and 30B and the non-discharge region 32 having respective independent cells.

The discharge cells 30R, 30G, and 30B defined by the barrier ribs 34 are optimized in shape for the propagation of the gas discharge in a manner that the region contributing substantially less to the sustain discharge and the luminance is shrunk. To be specific, both ends of each of the discharge cells 30R, 30G, and 30B in the extending direction (y-axis direction) of the address electrode becomes narrower in width as it goes away from the center of the discharge cells 30R, 30G, and 30B. With this structure, both end portions of the discharge cell 30R, 30G, are 30B have a trapezoidal shape, and the overall shape of the discharge cell 30R, 30G, and 30B becomes an octagonal shape.

The non-discharge region 32 is located in the region surrounded by imaginary horizontal lines (H) and imaginary vertical lines (V), both passing through the center of each discharge cell 30R, 30G, and 30B. The non-discharge region 32 serves to absorb heat from the neighboring discharge cells 30R, 30G, and 30B and to dissipate the heat outside the PDP.

For this arrangement, the barrier ribs 34 include first barrier rib members 34*a* placed parallel to the address electrodes and second barrier rib members 34*b* placed to be traverse to the first barrier rib members 34*a* at a predetermined angle. The second barrier rib members 34*b* are formed into an X shape between two neighboring discharge cells in the extending direction of the address electrodes 12.

Both the scan electrodes 16 and the sustain electrodes 18 are formed into a layered structure including transparent electrode layers 16*a* and 18*a* and bus electrode layers 16*b* and 118*b*. The transparent electrode layers 16*a* and 18*a* include a pair of line portions 26 placed at positions corresponding to two facing sides of each of the discharge cells 30R, 30G, and 30B and a pair of protrusion portions 28' extending from the respective line portions 26 towards the center of each of the discharge cells 30R, 30G, and 30B. The protrusion portions 28' are formed to match to the shape of the discharge cells 30R, 30G, and 30B so that the rear part of the protrusion portion 28' connecting to the line portion 26 decreases in width as it moves away from the center of the discharge cells 30R, 30G, and 30B.

A pair of the protrusion portions 28' has a rounded contour at both corners of each protrusion portion facing the paired protrusion portion so as to improve the level of precision in shaping the transparent electrode layers 16*a* and 18*a*. The radius R3 of curvature at the corner of the protrusion portions 28' must satisfy the following condition to be compatible with the maximum width of the protrusion portions 28'.

$$0.05c \leqq R3 \leqq 0.2c \qquad \text{Formula 3}$$

where c represents the maximum width of the protrusion portion 28' measured in the extending direction of the line portion 26 (see FIG. 2).

When the radius R3 of curvature at the corner is less than 0.05c, the rounded shape of the corners has little influence on reducing the process variation. Therefore, roughness at the corners increases due to the process variations. Also, when the radius R3 of curvature is greater than 0.2c, the rounded area of the corner is so enlarged that the overall shape of the protrusion portion 28' can be distorted. Given the maximum width c of the protrusion portions 28' in real applications, it is preferable to set the radius R3 of curvature at the corner to be in the range of 10~150 μm.

Although exemplary embodiments of the present invention have been described in detail hereinabove, it should be understood that many variations and/or modifications of the basic inventive concept taught therein will still fall within the spirit and scope of the present invention, as defined by the appended claims.

What is claimed is:

1. A Plasma Display Panel (PDP), comprising:

a first substrate and a second substrate facing each other;

address electrodes arranged on a first substrate;

barrier ribs defining discharge cells in a space between the first substrate and the second substrate; and display electrodes, arranged on the second substrate in a direction crossing the address electrodes, and including a pair of line portions arranged on both sides of each discharge cell and having a pair of protrusion portions, facing each other and extending from the respective line portions toward the center of each discharge cell, at least one of the pair of protrusion portions having a rounded contour at a corner connecting the protrusion portion to the line portion, and having a radius R2 of curvature of the corner connecting the protrusion portion to the line portion satisfying the following condition:

$$0.05b \leqq R2 \leqq 0.2b,$$

wherein b is a distance between the protrusion portions adjacent to each other, connecting an identical line portion, in the extending direction of the line portion.

2. The PDP of claim 1, wherein the radius R2 of curvature is within the range of 10~150 μm.

3. The PDP of claims 1, wherein the display electrode comprises a transparent electrode layer including the line portions and the protrusion portions and a bus electrode layer arranged on the line portions of the transparent electrode layer.

4. A Plasma Display Panel (PDP), comprising:

a first substrate and a second substrate facing each other;

address electrodes arranged on a first substrate;

barrier ribs defining discharge cells in a space between the first substrate and the second substrate; and display electrodes, arranged on the second substrate in a direction crossing the address electrodes, and including a pair of line portions arranged on both sides of each discharge cell and having a pair of protrusion portions, facing each other and, extending from the respective line portions toward the center of each discharge cell, wherein the protrusion portion of the display electrode has a rear part, connected to the line portion, having a portion becoming narrower in width in a direction away from the center of the discharge cell, wherein the pair of protrusion portions have rounded contours at both corners of each protrusion portion facing the paired protrusion portion and the corners of each protrusion portion facing the paired protrusion portion have a radius R3 of curvature satisfying the following condition:

$$0.05c \leqq R3 \leqq 0.2c,$$

wherein c is a maximum width of the protrusion portion measured in the extending direction of the line portion.

5. The PDP of claim 4, wherein the protrusion portion of the display electrode has a rear part, connected to the line portion, becoming narrower in width in a direction away from the center of the discharge cell.

6. The PDP of claim 4, wherein the radius R3 of curvature is within the range of 10~150 μm.

7. The PDP of claim 4, wherein the barrier ribs define non-discharge regions between the discharge cells, and wherein the non-discharge regions are arranged in a region surrounded by horizontal lines and vertical lines, both passing through the center of each discharge cell.

8. The PDP of claim 4, wherein each discharge cell has both ends, located in the extending direction of the address electrode, becoming narrower in width in a direction away from the center of the discharge cell.

9. The PDP of claim 4, wherein the display electrode comprises a transparent electrode layer including the line portions and the protrusion portions and a bus electrode layer arranged on the line portions of the transparent electrode layer.

* * * * *